United States Patent [19]

Cushman

[11] Patent Number: 4,590,824

[45] Date of Patent: May 27, 1986

[54] SCREWDRIVER

[76] Inventor: Cloyd Cushman, Rte. 2, Yale, Okla. 74085

[21] Appl. No.: 673,601

[22] Filed: Nov. 21, 1984

[51] Int. Cl.[4] ..... B25B 23/00

[52] U.S. Cl. ..... 81/440; 81/28; 81/450

[58] Field of Search ..... 81/440, 450, 439; 145/66, 61 L

[56] References Cited

U.S. PATENT DOCUMENTS

| | | | |
|---|---|---|---|
| 161,056 | 3/1875 | Patterson . | |
| 750,182 | 1/1904 | Furbish . | |
| 1,010,631 | 12/1911 | Holmquist | 81/440 |
| 1,552,361 | 9/1925 | Trombley . | |
| 1,616,300 | 2/1927 | Bido | 81/440 |
| 1,695,949 | 12/1928 | Borklund . | |
| 2,656,865 | 10/1953 | Bright . | |
| 3,013,594 | 12/1961 | Nehls . | |

FOREIGN PATENT DOCUMENTS

| | | | |
|---|---|---|---|
| 13668 | 5/1881 | Fed. Rep. of Germany | 145/61 L |
| 1045932 | 12/1953 | France | 81/450 |
| 109670 | 9/1917 | United Kingdom | 81/440 |
| 265816 | 2/1927 | United Kingdom | 81/440 |

*Primary Examiner*—Frederick R. Schmidt
*Assistant Examiner*—J. T. Zatarga
*Attorney, Agent, or Firm*—Head, Johnson & Stevenson

[57] ABSTRACT

A reversible bladed screwdriver comprising a slotted hollow handle and a pivotally attached reversible screwdriver blade capable of being reversed when in a fully extended position, being held in a conventional colinear position when retracted and being held at an oblique angle to the handle for maximum application of torque when in a semi-extended position. Such a screwdriver is particularly useful for one handed application of torque.

6 Claims, 10 Drawing Figures

SCREWDRIVER

BACKGROUND OF THE INVENTION

1. Field of the Invention

This invention relates to an improved screwdriver. More specifically, the invention relates to a hollow handled screwdriver with a pivotally reversible blade adapted to engage the handle in a non-linear manner such as to enhance the manual application of torque.

2. Description of the Prior Art

The basic concept of providing an otherwise conventional screwdriver with a replaceable blade or tip such that one handle will serve for various sizes and types of screwdriver tips is generally recognized and known in the art. Thus, it is known to provide a screwdriver handle with a blade that is held in position by a ball and detent or other mechanical structure such that the blade can be withdrawn and inverted and then reinserted into the handle backwards. In this manner, one screwdriver can be equipped with two different tips (frequently a Phillips and a conventional tip). It is also generally known that screwdrivers with either a ball and detent mechanical socket or magnetic assisted socket at the end opposite the handle can be used with compatible snap-in/snap-out tips wto produce a more versatile hand tool.

Historically, various other types of multiple tips screwdrivers have been suggested and employed with varying degrees of success. For example, in U.S. Pat. No. 161,056 a screwdriver with a flat shaft and pivotally attached dual tip blade is disclosed wherein either of two blades can be pivoted into position and clamped colinerar to the shaft for what would otherwise correspond to a conventional screwdriver usage. In U.S. Pat. No. 750,182, this pivoting dual tip concept is incorporated into a yoke that slides in and out of the handle of a screwdriver. When the yoke is fully extended out of the handle, the pivoting motion of the dual tip element can be used to select which tip is desired and then the entire yoke and pivoting tip element can be retracted back into the handle for conventional use of the screwdriver. In U.S. Pat. No. 1,552,361, a similar combination tool is disclosed wherein the entire blade pivots in and out of the handle about an axis at the midpoint of the hand tool (i.e., one end of the handle) wherein one end of the blade is a screwdriver and the other end is a putty knife. The handle is further equipped with a locking mechanism that retains the blade at the selected configuration. In U.S. Pat. No. 1,695,949, a duplex screwdriver is disclosed similar to the previous combination screwdriver/putty knife, except the locking mechanis is a concentric sleeve that slides to the top of the screwdriver handle to allow the rotation of the pivotally attached dual blade. In a similar manner, U.S. Pat. No. 2,656,865 discloses a dual bladed screwdriver wherein the blade pivots on an axle allowing one blade to be pivoted into the handle while the other extends in a colinear fashion analogous to the conventional screwdriver. This tool further provides for a ratchet type handle and the ability for the screwdriver blade to be held perpendicular to the handle. And in U.S. Pat. No. 3,013,594, a multiple screwdriver is disclosed wherein a dual tipped pivoting blade extends from and recedes into a hollow handle wherein in the extended configuration the dual blade can be pivoted such as to select the desired tip.

Although these prior art screwdrivers are categorically multiple tip screwdrivers and although many of them possess certain specific advantages and features, none of the prior art devices disclosed are multiple tip screwdrivers that combine both conventional colinear blade and handle orientation during operation with a blade that can be held oblique to the handle for improved manual application of torque. As such, the devices are not readily amenable to one handed operation or use by a party that has had a hand or arm amputated or similar disability.

SUMMARY OF THE INVENTION

In view of the prior art screwdriver devices, I have discovered an improved screwdriver comprising:

(a) a hollow handle means having a central opening colinear to the handle means wherein the sidewalls of the handle near the mouth of the opening are slotted on opposite sides such as to allow a reversible screwdriver blade to extend from and retract into the opening and in the fully extended position pivot through the slots and wherein the central opening is further equipped with at least one off-set recess adapted to accept one end of the reversible screwdriver blade in a semi-extended position and hold the blade at an angle oblique to the handle;

(b) a reversible screwdriver blade having a screwdriver tip at each end of the blade and a central slot in the blade longitudinal to the direction of the blade wherein the reversible screwdriver blade is operatively held within the central opening of the handle; and (c) an axle extending across the mouth of the opening in the handle and through the central slot in the blade such that the reversible blade can pivot about the axle through the slots in the handle when the blade is in the fully extended position.

The present invention also provides an improved reversible screwdriver according to the above wherein the user can select from any of four standard size and shape tips. Thus, the improved screwdriver according to the present invention further comprises:

(a) a hollow tip receiving means at each end of the reversible screwdriver blade wherein each tip means has a central opening colinear to the blade and wherein the sidewalls of the blade near the mouth of the openings are slotted on oppsoite sides;

(b) a pair of reversible screwdriver tips, one at each end of the reversible screwdriver blade, wherein each of the reversible screwdriver tips has a central slot longitudinal to the direction of the tip; and (c) a pair of axles, one at each end of the reversible screwdriver blade, wherein each of the axles extends across the mouth of one of the openings in the tip receiving means of the reversible screwdriver blade and through the central slot of the reversible tip such that the reversible tip can pivot about the axle through the slots in the hollow tip receiving means when the reversible tip is fully extended and is held colinear to the screwdriver blade when retracted into the hollow tip receiving means.

In one specific embodiment of the present invention the slotted openings on the opposite sides of the sidewalls of the handle operatively receive and engage to one of the reversible screwdriver tips when the tips are pivoted perpendicular to the longitudinal direction of the reversible screwdriver blade, thus allowing for maximum application of torque and 90 degree operation of the screwdriver. In another specific embodiment of the present invention, the central opening in the hollow handle is equipped with a plurality of off-set recesses adapted to accept one end of the reversible screwdriver blade and hold the blade in a variety of semi-extended positions corresponding to the blade being oriented at a variety of oblique angles to the handle.

It is a primary object of the present invention to provide a multiple tipped screwdriver wherein the user can select from up to four various sizes and types of screwdriver tips, yet all tips are permanently attached to the screwdriver as a single hand held tool. It is a further object to provide a screwdriver with a hollow slotted handle that accepts and holds a master reversible screwdriver blade at various oblique angles to the handle as well as colinear to the handle, thus allowing for the manual application of various degrees of torque. It is still a further object of the present invention to provide a reversible master blade with slotted ends wherein each end has a reversible tip, thus permitting a choice of four sizes of tips as well as permitting the screwdriver tip to be oriented at right angles to the handle during use. And, still a further object of the present invention is to provide a highly versatile screwdriver that can readily and conveniently be used one handed by an amputee with only one arm or hand or similar disabled person. Fulfillment of these objects and the presence and fulfillment of additional objects will become apparent upon complete reading of the specification and claims taken in conjunction with the attached drawings.

BRIEF DESCRITPTION OF THE DRAWINGS

FIG. 1 a side view of the reversible bladed, hollow handled screwdriver according to the present invention.

DESCRIPTION OF THE PREFERRED EMBODIMENTS

Figures 1, 2, 3:
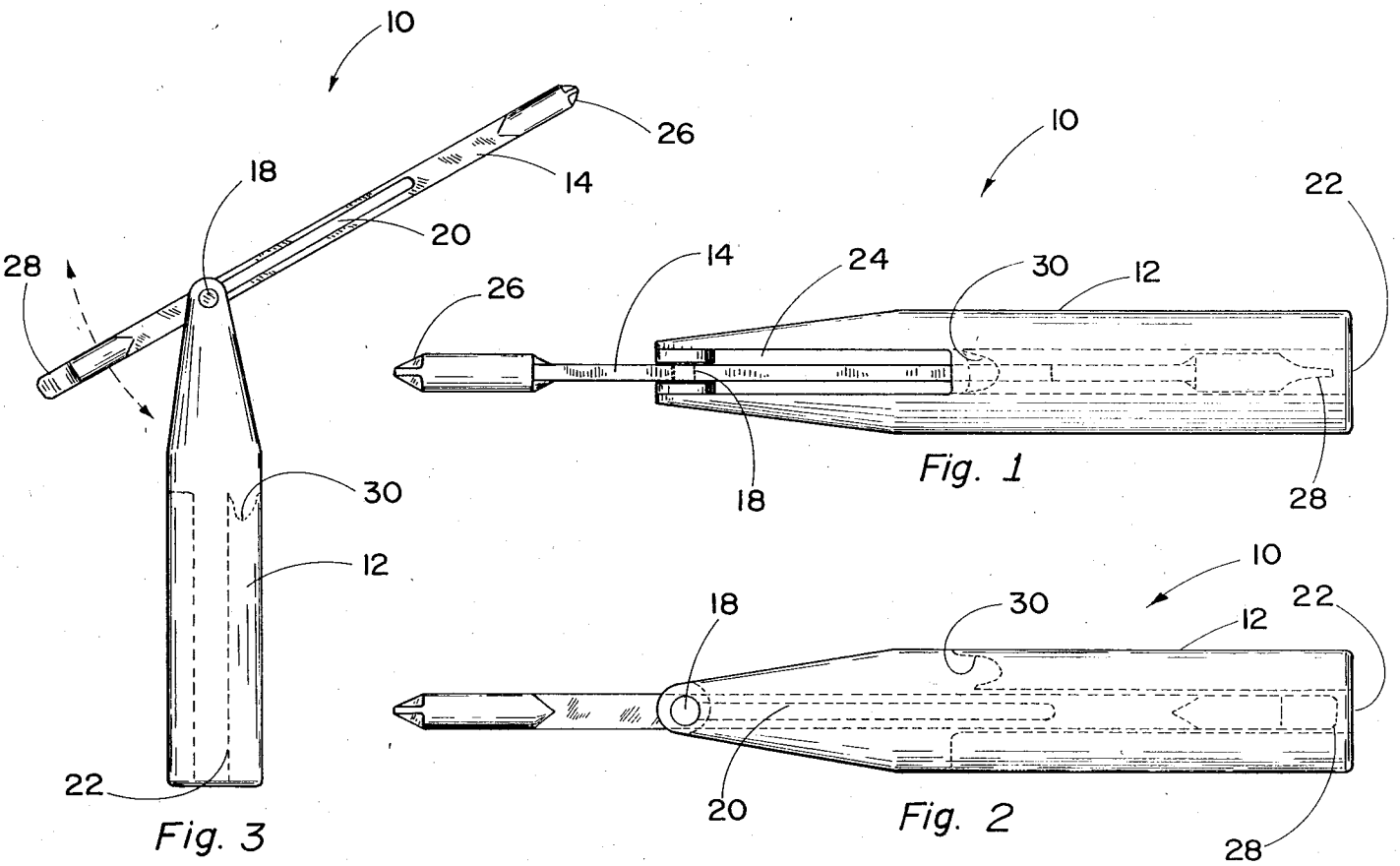
FIG. 2 is another side view of the screwdriver of FIG. 1 after rotating the screwdriver 90 degrees about the longitudinal axis.
FIG. 3 is a side view similar to FIG. 2 with the reversible blade withdrawn from the hollow handle and partially rotated as if to change tips.

The improved screwdriver according to the present invention, how it functions, how it differs from the prior art and the advantages of using the screwdriver can perhaps be best understood and explained by reference to the drawings. FIGS. 1 and 2 illustrate one specific embodiment of the improved screwdriver according to the present invention, generally designated by the numeral 10. As illustrated, the screwdriver 10 consists of a hollow handle 12 with a multiple tip blade 14 pivotally attached to the handle 12 at one end by a rivet of axle 18 passing through a slot 20. The slot 20 is centrally positioned in blade 14 extending longitudinally to the blade. Consequently, the blade 14 can be slid lengthwise within the hollow opening 22 of handle 12. Because of this relative sliding motion, the blade 14 can be inserted into the handle or withdrawn from the handle.

As illustrated in the side view of FIG. 1, the handle 12 is further equipped with a slot opening 24 at the rivet or axle end of the handle. This slot 24 is colinear with the handle 12 and colinear with the central opening 22 within which the blade 14 slides. The slot 24 is also of sufficient length to allow the blade 14 when in the fully withdrawn configuration (i.e., slid as far out of the handle as possible) to rotate external to the handle as suggested by the dashed lines of FIG. 3. In this manner, the Phillips screwdriver tip 26 located at one end of blade 14 can exchange positions with the regular screwdriver tip 28 at the other end of the blade. Thus, the user of the screwdriver can select which type or size of screwdriver tips to be employed merely by reversing the direction of the blade.

Figure 4:
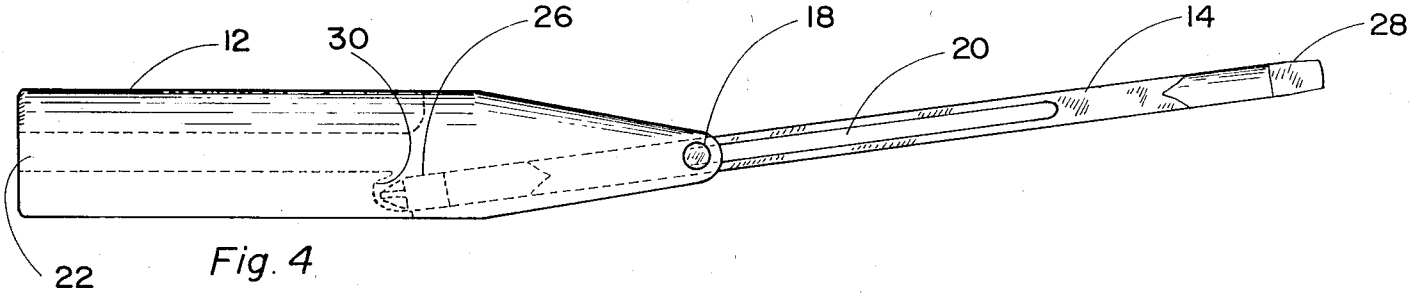
FIG. 4 represents a side view of the screwdriver of FIGS. 1 and 2 with the blade partially extended from the handle and held at a non-colinear inclination to the handle such as to enhance the manual application of torque.
Figure 9:
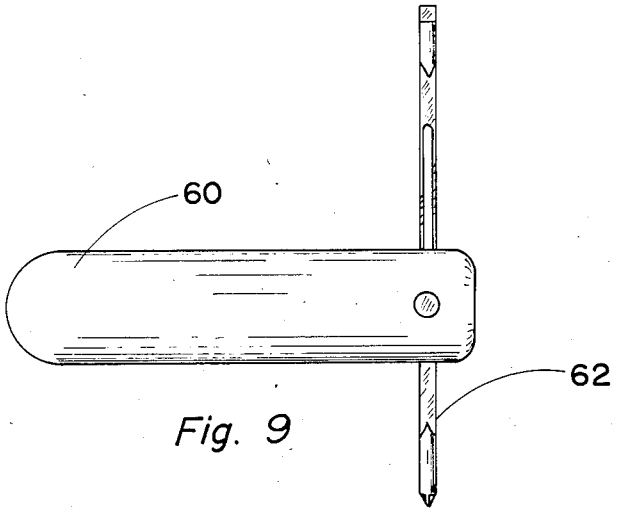
FIG. 9 is a side view of another alternate embodiment similar to the embodiment of FIGS. 1 through 4 with the blade fully extended and positioned at a right angle to the handle during use such as to maximize the manual application of the torque.

As further illustrated in FIGS. 1 through 3, the hollow handle 12 with central opening 22 is equipped with an internal recess 30 off-set to one side of the handle and positioned essentially midway through the internal opening 22. This off-set recess 30 or internal hole is of sufficient depth to receive and engage one end of the blade 14 and thus hold the blade in a semi-extended configuration (see FIG. 4). In this semi-extended configuration, the blade is held at a preselected incline (non-colinear) relative to the handle 12 and central opening 22. In this manner, the screwdriver of FIGS. 1 through 5 represents a highly versatile, multi-tipped hand tool wherein the user can select one of two distinct tips and employ one of three different angles of inclination between the blade and handle during use. In other words, either the Hillips tip or the regular tip can be selected and the blade can be either colinear with the handle (see FIGS. 1 and 2), slightly inclined to the handle (see FIG. 4) or perpendicular to the handle (see FIG. 9). Each of these configurations represents varying degrees of thrust and torque during use. For example, the conventional configuration of FIGS. 1 and 2 represents maximum application of manual thrust at the expense of manual application of torque. In contrast, the configuration of FIG. 9 represents maximum manual application of torque at the expense of thrust. The inclined configuration of FIG. 4 represents what is felt to be a novel balance between improved torque and loss of manual thrust. It is this operative feature and mechanical method of achieving this operative feature that is felt to be novel and thus distinguishes the improved screwdriver according to the present invention from the prior art devices.

Figure 6:
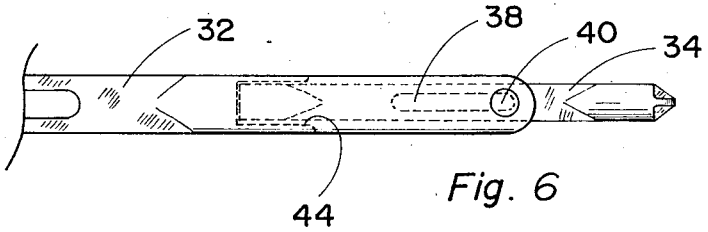
FIG. 6 is a close up silhouetted view of the reversible screwdriver tips of the embodiment of FIG. 5.
Figure 5:
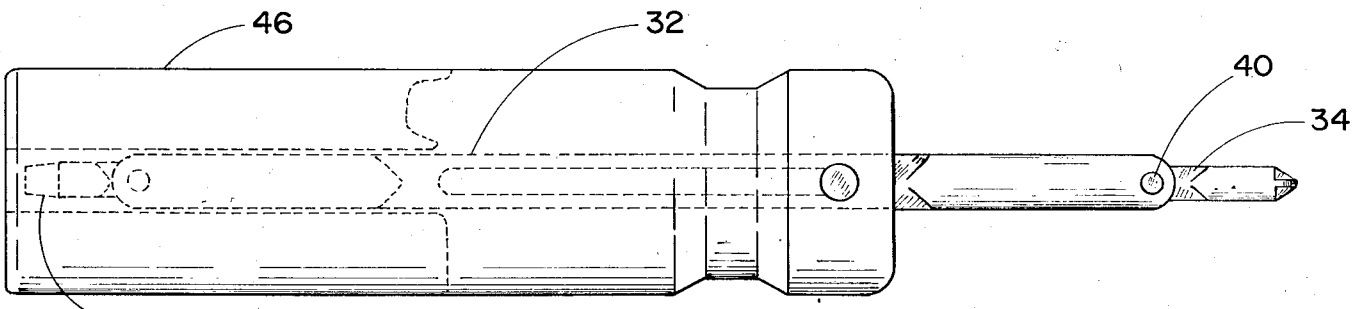
FIG. 5 represents a side view of an alternate embodiment of a reversible bladed, hollow handled screwdriver according to the present invention wherein each end of the blade is equipped with reversible screwdriver tips.
Figure 7:
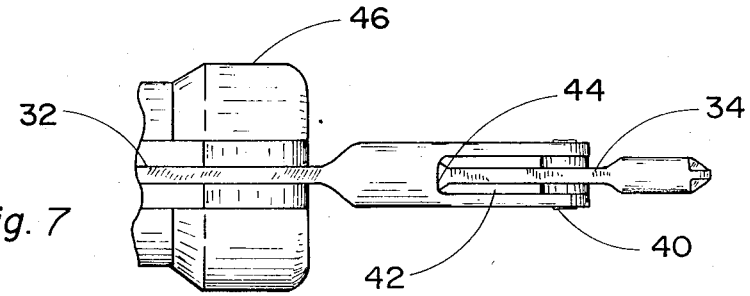
FIG. 7 is another partial side view of the reversible screwdriver tips of the embodiment of FIG. 5 after rotating the screwdriver 90 degrees about the longitudinal axis.
Figure 10:
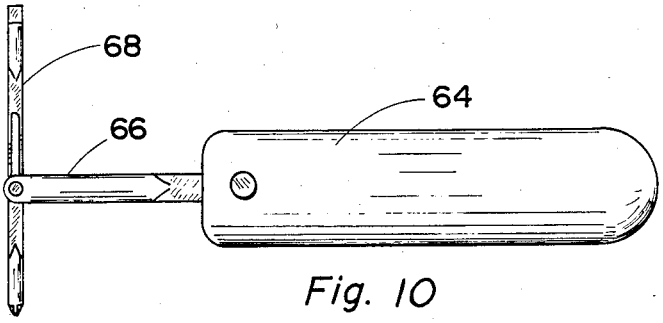
FIG. 10 is a side view of another alternate embodiment similar to the embodiment of FIGS. 5 through 7 with the blade fully extended and the tip positioned at a right angle to the blade and handle during use such as to maximize the manual application of the torque.

FIGS. 5 through 7 illustrate an alternate embodiment of the improved screwdriver according to the present invention wherein the use of the hand tool involves the selection of four different screwdriver tips. As illustrated, this is accomplished by virtue of each end of the reversible blade 32 being made up of a reversible tip element 34 and 36. Each reversible tip element 34 and 36 involves a pair of individual tips, one on each end of the pivotal or reversible element, reminiscent of the pivoting reversible blade. In other words, the pair of tips on element 34 are reversed by virtue of the sliding action along slot 38 and pin 40, thus allowing the tip element 34 to revolve through slot 42 and around pin 40 and then be reinserted into opening 44 of blade 32. Similarly, when the other end of the blade 32 is external to the handle 46, the reversible tip element 36 can be withdrawn from the blade and spun or revolved around the rivet or pivot pin of element 36 and reinserted into the blade, thus reversing the tips of element 36. As illustrated in FIG. 10, because of the reversible tip feature, this specific embodiment of the invention can be employed in a 90 degree configuration by virtue of the tip element itself being perpendicular to the blade and handle. Thus, the embodiment of FIGS. 6 and 7 not only allows the user to select from four different tips, but gives a fourth operational variation and screwdriver configuration, thus representing an even more versatile tool than the embodiment of FIGS. 1 through 5.

Figure 8:
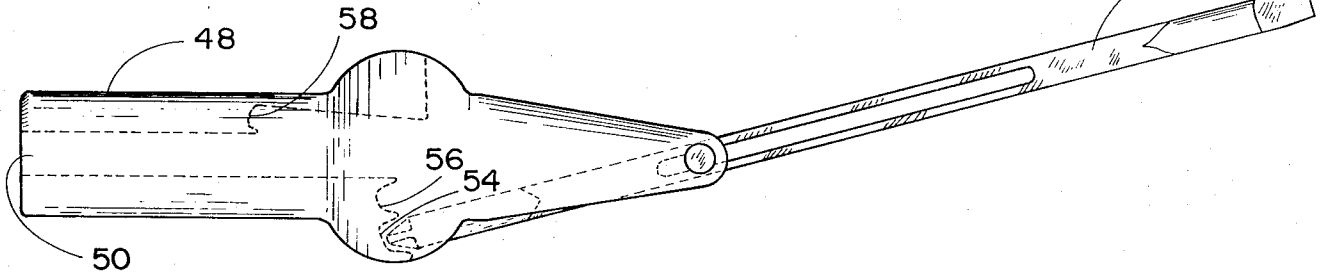
FIG. 8 is a side view of a third alternate embodiment of a reversible bladed, hollow handled screwdriver according to the present invention wherein the hollow handle contains multiple recessions corresponding to alternate angles of inclination of the blade relative to the handle.

FIG. 8 illustrates an alternate embodiment of the screwdriver handle according to the present invention. As illustrated in this specific embodiment, the screwdriver handle 48 is traversed by a central opening 50 which slidably accepts the reversible blade 52 in a manner identical to the previous embodiments. However, the handle 48 in this case has a pair of internal off-set recesses 54 and 56 positioned at different horizontal displacements along the inner wall of opening 50 and a third off-set recess 58 positioned at a different longitudinal displacement along the inner wall of opening 50. Each of these off-set recesses 54, 56 and 58 is adapted to accept and retain the blade 52 at different angles of inclination relative to the handle 48 during use of the screwdriver. As such, the tool is again more versatile than the previously described specific embodiments in that various degrees of manual torque/thrust can be achieved by selecting which internal off-set recess is to receive the inner tip of the blade.

FIGS. 9 and 10 further illustrate alternate methods of achieving maximum torque when using the improved screwdriver according to the present invention. FIG. 9 illustrates the positioning of the reversible blade 62 perpendicular to the handle 60 in order to achieve optimum torque during use. FIG. 10 illustrates the equivalent feature when using a reversible tipped embodiment. In this case, the handle 64 and colinear blade 66 are perpendicular to the reversible tip element 68 during use.

It is contemplated that the improved screwdriver according to the present invetnion can be manufactured out of any of the conventional materials presently used in the screwdriver art. As illustrated in the figures, the device can be made to physically resemble various conventional designs for screwdrivers as generally known in the art, as well as other acceptable physical appearances. It should be further appreciated that the screwdriver can be made in various sizes, shapes and configurations compatible with the overall concepts as illustrated in the present invention. It should be further appreciated that the dimensions and shape of the screwdriver blade, handle and central opening, as well as the various slots and pivot pins can be geometrically shaped, positioned and designed without departing from the basic concepts of the present invention. Thus, the blade can be either tubular, cylindrical, or a combination thereof. Similarly, the central opening can be geometrically shaped to be compatible with the particular cross-sectional configuration of the blade to be held within the handle. Preferably, the blade is to be made of tool grade metal and the handle of impact plastic as generally known in the art.

The advantages and benefits associated with the use of the improved screwdriver according to the present invention are considered numerous and significant. First and foremost, the device is a relatively versatile, inexpensive, yet reliable multi-tipped screwdriver. Furthermore, the tool provides mutliple tips which can be readily interchanged without necessitating the removal and reinsertion of any given component (i.e., all multiple tips are an integral and permanently attached component of the overall hand tool). As such, the device is particularly useful for one-handed operations, even if the user and operator, because of a disability, can use only one hand. In addition, the actual application of torque and thrust can be readily adjusted or selected using only one hand.

Having thus described the invention with a certain degree of particularity, it is manifest that many changes may be made in the details of construction and the arrangement of components without departing from the spirit and scope of this disclosure. Therefore, it is to be understood that the invention is not limited to the embodiments set forth herein for the purposes of exemplification, but is to be limited only by the scope of the attached claims, including a full range of equivalents to which each element thereof is entitled.

I claim:

1. An improved screwdriver comprising:

(a) a hollow handle means having a central opening colinear to said handle means wherein the sidewalls of said handle near the mouth of the opening are slotted on opposite sides such as to allow a reversible screwdriver blade to extend from and retract into said opening and in the fully extended position pivot through said slots and wherein said central opening is further equipped with at least one off-set recess adapted to accept one end of said reversible screwdriver blade in a semi-extended position and hold the blade at an angle oblique to said handle;

(b) a reversible screwdriver blade having a screwdriver tip at each end of said blade and a central slot in said blade longitudinal to the direction of said blade wherein said reversible screwdriver blade is operatively held within said central opening of said handle; and (c) an axle extending across the mouth of said opening in said handle and through the central slot in said blade such that said reversible blade can pivot about said axle through said slots in said handle when said blade is in the fully extended position.

2. An improved screwdriver of claim 1 further comprising:

(a) a hollow tip receiving means at each end of said reversible screwdriver blade wherein each tip means has a central opening colinear to said blade and wherein the sidewalls of said blade near the mouth of the openings are slotted on opposite sides;

(b) a pair of reversible screwdriver tips, one at each end of said reversible screwdriver blade, wherein each of said reversible screwdriver tips has a central slot longitudinal to the direction of said tip; and (c) a pair of axles, one at each end of said reversible screwdriver blade, wherein each of said axles extends across the mouth of one of said openings in said tip receiving means of said reversible screwdriver blade and through said central slot of said reversible tip such that said reversible tip can pivot about said axle through said slots in said hollow tip receiving means when said reversible tip is fully extended and is held colinear to said screwdriver blade when retracted into said hollow tip receiving means.

3. An improved screwdriver of claim 2 wherein said slotted openings on opposite sides of the sidewall of said handle operatively receive and engage to one of said reversible screwdriver tips when said tips are pivoted perpendicular to the longitudinal direction of said reversible screwdriver blade.

4. An improved screwdriver of claim 1 further comprising a plurality of off-set recesses adapted to accept one end of said reversible screwdriver blade in a variety of semi-extended positions corresponding to said blade being held at various oblique angles to said handle.

5. An improved screwdriver of claim 2 further comprising a plurality of off-set recesses adapted to accept one end of said reversible screwdriver blade in a variety of semi-extended positions corresponding to said blade being held at various oblique angles to said handle.

6. An improved screwdriver of claim 3 further comprising a plurality of off-set recesses adapted to accept one end of said reversible screwdriver blade in a variety of semi-extended positions corresponding to said blade being held at various oblique angles to said handle.

* * * * *